US007282099B2

(12) United States Patent
McDermott et al.

(10) Patent No.: US 7,282,099 B2
(45) **Date of Patent: *Oct. 16, 2007**

(54) DENSE PHASE PROCESSING FLUIDS FOR MICROELECTRONIC COMPONENT MANUFACTURE

(75) Inventors: Wayne Thomas McDermott, Fogelsville, PA (US); Richard Carl Ockovic, Northampton, PA (US); Alexander Schwarz, Bethlehem, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 457 days.

This patent is subject to a terminal disclaimer.

(21) Appl. No.: 10/253,296

(22) Filed: Sep. 24, 2002

(65) Prior Publication Data

US 2004/0055624 A1 Mar. 25, 2004

(51) Int. Cl.
*B08B 3/00* (2006.01)

(52) U.S. Cl. ..... 134/34; 134/2; 134/3; 134/10; 134/11; 134/12; 134/25.4; 134/31; 134/35; 134/42; 438/906

(58) Field of Classification Search ..... 134/2, 134/3, 31, 34, 10, 11, 12, 35, 42; 438/906
See application file for complete search history.

(56) References Cited

U.S. PATENT DOCUMENTS

| | | | | |
|---|---|---|---|---|
| 4,032,337 A | | 6/1977 | Boyer | 75/226 |
| 5,417,768 A | * | 5/1995 | Smith et al. | 134/10 |
| 5,509,431 A | * | 4/1996 | Smith et al. | 134/95.1 |
| 5,868,856 A | | 2/1999 | Douglas et al. | 134/2 |
| 5,868,862 A | | 2/1999 | Douglas et al. | 134/26 |
| 5,976,264 A | | 11/1999 | McCullough | 134/2 |
| 6,023,933 A | | 2/2000 | Langan et al. | 62/50.2 |
| 6,092,538 A | | 7/2000 | Arai et al. | 134/1.3 |
| 6,113,708 A | | 9/2000 | Hopple et al. | 134/7 |
| 6,242,165 B1 | | 6/2001 | Vaartstra | 430/329 |
| 6,277,753 B1 | | 8/2001 | Mullee et al. | 438/692 |
| 6,306,564 B1 | | 10/2001 | Mullee | 430/329 |
| 6,331,487 B2 | | 12/2001 | Koch | 438/692 |
| 6,338,253 B1 | | 1/2002 | Freedman | 62/48.1 |
| 6,403,544 B1 | | 6/2002 | Davenhall et al. | 510/175 |

(Continued)

FOREIGN PATENT DOCUMENTS

EP 0726099 A2 8/1996

(Continued)

*Primary Examiner*—M. Kornakov
(74) *Attorney, Agent, or Firm*—Lina Yang; Geoffrey L. Chase

(57) ABSTRACT

Method for processing an article by contacting the article with a dense fluid. The article is introduced into a sealable processing chamber and the processing chamber is sealed. A dense fluid is prepared by introducing a subcritical fluid into a pressurization vessel and isolating the vessel, and then heating the subcritical fluid at essentially constant volume and essentially constant density to yield a dense fluid. At least a portion of the dense fluid is transferred from the pressurization vessel to the processing chamber, wherein the transfer of the dense fluid is driven by the difference between the pressure in the pressurization vessel and the pressure in the processing chamber, thereby pressurizing the processing chamber with transferred dense fluid. The article is contacted with the transferred dense fluid to yield a spent dense fluid and a treated article, and the spent dense fluid is separated from the treated article.

12 Claims, 4 Drawing Sheets

U.S. PATENT DOCUMENTS

| | | | | |
|---|---|---|---|---|
| 6,454,869 | B1 * | 9/2002 | Cotte et al. | 134/2 |
| 6,537,916 | B2 * | 3/2003 | Mullee et al. | 438/692 |
| 6,602,349 | B2 * | 8/2003 | Chandra et al. | 134/19 |
| 6,669,785 | B2 * | 12/2003 | DeYoung et al. | 134/3 |
| 6,712,081 | B1 * | 3/2004 | Uehara et al. | 134/105 |
| 2002/0048731 | A1 | 4/2002 | Mullee | |
| 2002/0088477 | A1 * | 7/2002 | Cotte et al. | 134/2 |
| 2004/0055621 | A1 * | 3/2004 | McDermott et al. | 134/1.3 |
| 2004/0144399 | A1 * | 7/2004 | McDermott et al. | 134/1 |

FOREIGN PATENT DOCUMENTS

| | | |
|---|---|---|
| JP | 08-197021 | 8/1996 |
| WO | WO84/02291 | 6/1984 |
| WO | WO99/61177 | 12/1999 |
| WO | WO 01/32323 | 5/2001 |
| WO | WO 01/78911 | 10/2001 |

* cited by examiner

DENSE PHASE PROCESSING FLUIDS FOR MICROELECTRONIC COMPONENT MANUFACTURE

BACKGROUND OF THE INVENTION

Supercritical fluid extraction processes are widely used in the food, pharmaceutical, and chemical industries to separate specific components from feedstock materials. These processes are used for the purification of feedstock materials, wherein the removed components are undesirable contaminants, and also for the extraction and recovery of specific components as valuable final products. Supercritical fluids also are used for the cleaning of manufactured parts and fabrics as an alternative to the use of chlorinated solvents.

The cleaning of semiconductor components using supercritical fluids to remove contaminants is a new and rapidly-developing application of this technology in the electronics industry. The use of supercritical fluids in etching and deposition processes, wherein the supercritical fluids serve as carriers of reactant materials, also is developing rapidly in the industry. The supercritical fluids used in these processes must have an extremely high level of purity to avoid residual contamination of semiconductor substrates by particulates, films, or undesirable components that cause short circuits, open circuits, silicon crystal stacking faults, and other defects. These defects result in significant yield reductions and increases in processing costs in the manufacture of microelectronic components. Any significant amount of particulate or molecular contaminants in the supercritical fluid can contaminate semiconductor substrate surfaces and reduce microchip yield to uneconomical levels.

Supercritical fluids for use in these applications typically are prepared by the use of mechanical compressors or pumps to generate the high pressures needed to reach the supercritical region. The most reliable of these mechanical compressors or pumps use pistons with compression seals to separate the pressurized fluid from the hydraulic and lubricating fluids used in compressor operation. Such seals may leak due to wear or other mechanical failure and thereby contaminate the fluids being pressurized. Alternative compressor designs use an oscillating metal diaphragm to separate the pressurized fluid from a hydraulic fluid. However, the diaphragms of such compressors are prone to fatigue failure and require frequent maintenance. Fatigue failure of the diaphragm in such compressors will contaminate the fluid being pressurized.

It is desirable to produce dense fluids, including supercritical fluids, of extremely high purity for applications in microelectronics manufacturing without the use of mechanical pumps or compressors. The present invention, which is described below and defined by the claims which follow, provides an alternative method to produce extremely high purity dense fluids for these applications.

BRIEF SUMMARY OF THE INVENTION

The invention relates to a method for processing an article comprising:

(a) introducing the article into a sealable processing chamber and sealing the processing chamber;

(b) preparing a dense fluid by:

(b1) introducing a subcritical fluid into a pressurization vessel and isolating the vessel; and (b2) heating the subcritical fluid at essentially constant volume and essentially constant density to yield a dense fluid;

(c) transferring at least a portion of the dense fluid from the pressurization vessel to the processing chamber, wherein the transfer of the dense fluid is driven by the difference between the pressure in the pressurization vessel and the pressure in the processing chamber, thereby pressurizing the processing chamber with transferred dense fluid;

(d) contacting the article with the transferred dense fluid to yield a spent dense fluid and a treated article; and (e) separating the spent dense fluid from the treated article.

The dense fluid may be generated in (b2) at a reduced temperature in the pressurization vessel below about 1.8, wherein the reduced temperature is defined as the average absolute temperature of the dense fluid in the pressurization vessel after heating divided by the absolute critical temperature of the fluid.

The contacting of the article with the dense fluid in the processing chamber typically is effected at a reduced temperature in the processing chamber between about 0.8 and about 1.2, wherein the reduced temperature is defined as the average absolute temperature of the dense fluid in the processing chamber during (d) divided by the absolute critical temperature of the dense fluid.

The dense fluid may comprise one or more components selected from the group consisting of carbon dioxide, nitrogen, methane, oxygen, ozone, argon, hydrogen, helium, ammonia, nitrous oxide, hydrocarbons having 2 to 6 carbon atoms, hydrogen fluoride, hydrogen chloride, sulfur trioxide, fluoroform, sulfur hexafluoride, nitrogen trifluoride, monofluoromethane, difluoromethane, trifluoromethane, trifluoroethane, tetrafluoroethane, pentafluoroethane, perfluoropropane, pentafluoropropane, hexafluoroethane, and tetrafluorochloroethane.

The method may further comprise one or more steps selected from the group consisting of (1) introducing one or more processing agents into the dense fluid during the transferring of the dense fluid from the pressurization vessel to the processing chamber, (2) introducing one or more processing agents into the processing chamber before the transferring of the dense fluid from the pressurization vessel to the processing chamber, (3) introducing one or more processing agents into the dense fluid in the processing chamber after the transferring of the dense fluid from the pressurization vessel to the processing chamber, (4) introducing one or more processing agents into the pressurization vessel before introducing the subcritical fluid into the pressurization vessel, (5) introducing one or more processing agents into the pressurization vessel after introducing the subcritical fluid into the pressurization vessel but before heating the pressurization vessel, and (6) introducing one or more processing agents into the pressurization vessel after introducing the subcritical fluid into the pressurization vessel and after heating the pressurization vessel.

The total concentration of the one or more processing agents in the dense fluid may be between about 0.5 and 20 wt %.

The one or more processing agents may be selected from the group consisting of acetylenic alcohols, acetylenic diols, non-ionic alkoxylated acetylenic diol surfactants, non-ionic self-emulsifiable acetylenic diol surfactants, siloxane polymers, silicone-based surfactants, tertiary alkyl amines, quaternary alkyl amines, tertiary di-amines, quaternary di-amines, amides, dimethyl formamide, dimethyl acetamide, alkyl alkanolamines, dimethanolethylamine, beta-diketone ligands, beta-ketoimine ligands, trifluoroacetic anhydride, halogenated carboxylic acids, halogenated glycols, halogenated alkanes, and halogenated ketones.

Alternatively, the one or more processing agents may be selected from the group consisting of hydrogen fluoride, hydrogen chloride, hexafluoroethane, and nitrogen trifluoride. In another alternative, the one or more processing agents may be selected from the group consisting of organometallic precursors, photoresists, photoresist developers, interlayer dielectric materials, silane reagents, and stain-resistant coatings.

The pressure of the spent dense fluid may be reduced to yield at least a fluid phase and a residual compound phase, and the phases may be separated to yield a purified fluid and recovered residual compounds. This purified fluid may be recycled to provide a portion of the subcritical fluid before pressurization The pressure of the purified fluid may be reduced to yield a further-purified fluid phase and an additional residual compound phase, and the phases may be separated to yield a further-purified fluid and additional recovered residual compounds. This further-purified fluid may be recycled to provide a portion of the subcritical fluid before pressurization.

The subcritical fluid in the pressurization vessel prior to heating may comprise a vapor phase, a liquid phase, or coexisting vapor and liquid phases.

The invention also relates to an apparatus for processing an article which comprises:

(a) a fluid storage tank containing a subcritical fluid;
(b) one or more pressurization vessels and piping means for transferring the subcritical fluid from the fluid storage tank to one or more pressurization vessels;
(c) heating means to heat the contents of each of the one or more pressurization vessels at essentially constant volume and essentially constant density to convert the subcritical fluid into a dense fluid;
(d) a sealable processing chamber for contacting an article with the dense fluid; and
(e) piping means for transferring the dense fluid from the one or more pressurization vessels into the sealable processing chamber.

This apparatus may further comprise one or more processing agent storage vessels and pumping means to inject the one or more processing agents into the piping means for transferring the dense fluid from the one or more pressurization vessels to the sealable processing chamber.

The apparatus may further comprise one or more means selected from the group consisting of (1) means for introducing one or more processing agents into the dense fluid during the transferring of the dense fluid from the pressurization vessel to the processing chamber,
(2) means for introducing one or more processing agents into the processing chamber before the transferring of the dense fluid from the pressurization vessel to the processing chamber,
(3) means for introducing one or more processing agents into the dense fluid in the processing chamber after the transferring of the dense fluid from the pressurization vessel to the processing chamber,
(4) means for introducing one or more processing agents into the pressurization vessel before introducing the subcritical fluid into the pressurization vessel,
(5) means for introducing one or more processing agents into the pressurization vessel after introducing the subcritical fluid into the pressurization vessel but before heating the pressurization vessel, and
(6) means for introducing one or more processing agents into the pressurization vessel after introducing the subcritical fluid into the pressurization vessel and after heating the pressurization vessel.

In addition, the apparatus may further comprise pressure reduction means and phase separation means to separate a spent dense fluid withdrawn from the processing chamber to yield at least a purified fluid and one or more recovered residual compounds. Also, the apparatus may further comprise recycle means to recycle the purified fluid to the fluid storage tank.

In another embodiment, the invention relates to a method for making a dense processing fluid comprising:

(a) introducing a subcritical fluid into a pressurization vessel and isolating the vessel;
(b) heating the subcritical fluid in the pressurization vessel at essentially constant volume and essentially constant density to provide a dense fluid;
(c) withdrawing the dense fluid from the pressurization vessel, and
(d) mixing a processing agent with the dense fluid to provide the dense processing fluid.

The dense fluid typically is generated in the pressurization vessel at a reduced temperature of below about 1.8, wherein the reduced temperature is defined as the average absolute temperature of the fluid in the pressurization vessel after heating divided by the absolute critical temperature of the fluid.

The dense fluid may comprise one or more components selected from the group consisting of carbon dioxide, nitrogen, methane, oxygen, ozone, argon, hydrogen, helium, ammonia, nitrous oxide, hydrocarbons having 2 to 6 carbon atoms, hydrogen fluoride, hydrogen chloride, sulfur trioxide, fluoroform, sulfur hexafluoride, nitrogen trifluoride, monofluoromethane, difluoromethane, trifluoromethane, trifluoroethane, tetrafluoroethane, pentafluoroethane, perfluoropropane, pentafluoropropane, hexafluoroethane, and tetrafluorochloroethane.

The one or more processing agents may be selected from the group consisting of acetylenic alcohols, acetylenic diols, non-ionic alkoxylated acetylenic diol surfactants, non-ionic self-emulsifiable acetylenic diol surfactants, siloxane polymers, silicone-based surfactants, tertiary alkyl amines, quaternary alkyl amines, tertiary di-amines, quaternary di-amines, amides, dimethyl formamide, dimethyl acetamide, alkyl alkanolamines, dimethanolethylamine, beta-diketone ligands, beta-ketoimine ligands, trifluoroacetic anhydride, halogenated carboxylic acids, halogenated glycols, halogenated alkanes, and halogenated ketones.

Alternatively, the one or more processing agents may be selected from the group consisting hydrogen fluoride, hydrogen chloride, hexafluoroethane, and nitrogen trifluoride. In another alternative, the one or more processing agents may be selected from the group consisting of organometallic precursors, photoresists, photoresist developers, interlayer dielectric materials, silane reagents, and stain-resistant coatings.

The subcritical fluid in the pressurization vessel may comprise a vapor phase, a liquid phase, or coexisting vapor and liquid phases. In one option, the subcritical fluid in the pressurization vessel may comprise coexisting vapor and liquid phases, and the density of the subcritical fluid may be fixed by selecting the relative volumes of the coexisting vapor and liquid phases in the subcritical fluid introduced into the pressurization vessel.

The invention also relates to a method for making a dense processing fluid comprising:

(a) introducing a subcritical fluid into a pressurization vessel and isolating the vessel;

(b) heating the subcritical fluid in the pressurization vessel at essentially constant volume and essentially constant density to provide a dense fluid;

(c) introducing a processing agent into the pressurization vessel prior to (a), or following (a) and prior to (b), or following (b); and (d) withdrawing the dense processing fluid from the pressurization vessel.

Another embodiment of the invention relates to a method for making a dense fluid comprising:

(a) introducing a subcritical fluid into a pressurization vessel and isolating the vessel;

(b) heating the subcritical fluid in the pressurization vessel at essentially constant volume and essentially constant density to provide a dense fluid, wherein the reduced temperature in the pressurization vessel after heating is below about 1.8, the reduced temperature being defined as the average absolute temperature of the dense fluid in the pressurization vessel after heating divided by the absolute critical temperature of the fluid; and (c) withdrawing the dense fluid from the pressurization vessel.

DETAILED DESCRIPTION OF THE INVENTION

Figure 1:
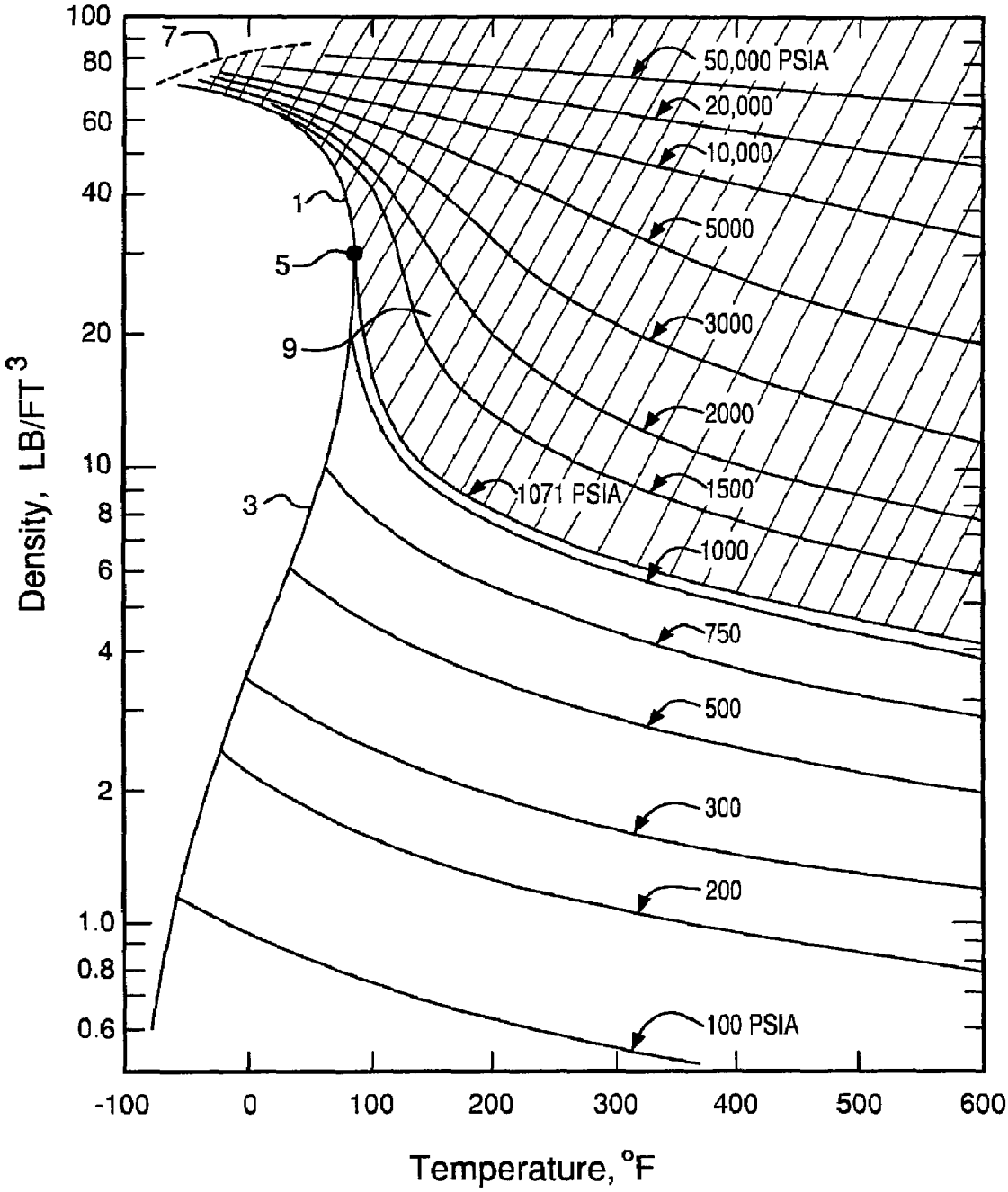
FIG. 1 is a density-temperature phase diagram for carbon dioxide.

Supercritical fluids are well-suited to convey processing agents to articles such as microelectronic components undergoing processing steps and for removing undesirable components from the microelectronic components upon completion of the process steps. These process steps typically are carried out batchwise and may include cleaning, film stripping, etching, deposition, drying, and planarization. Other uses for supercritical fluids include precipitation of nanoparticles and suspension of metallic nano-crystals.

Supercritical fluids are ideal for these applications because these fluids characteristically have high solvent power, low viscosity, high diffusivity, and negligible surface tension relative to the articles being processed. As pointed out above, the supercritical fluids used in microelectronic processing must have extremely high purity, much higher than that of supercritical fluids used in other applications. The generation of extremely high purity supercritical fluids for these applications must be done with great care, preferably using the methods described herein.

A single-component supercritical fluid is defined as a fluid above its critical temperature and pressure. A related single-component fluid having similar properties to a supercritical fluid is a single-phase fluid which exists at a temperature below its critical temperature and a pressure above its liquid saturation pressure. In the present disclosure, the term "dense fluid" as applied to a single-component fluid is defined to include both a supercritical fluid and a single-phase fluid which exists at a temperature below its critical temperature and a pressure above its saturation pressure. A dense fluid which is a single-component fluid also can be defined as a single-phase fluid at a pressure above its critical pressure or a pressure above its liquid saturation pressure. The term "component" as used herein means an element (for example, hydrogen, helium, oxygen, nitrogen) or a compound (for example, carbon dioxide, methane, nitrous oxide, sulfur hexafluoride).

A dense fluid alternatively may comprise a mixture of two or more components. In this case, a dense fluid is defined as a single-phase multi-component fluid of a given composition which is above its saturation or bubble point pressure, or which has a combination of pressure and temperature above the critical point. The critical point for a multi-component fluid is defined as the combination of pressure and temperature above which the fluid of a given composition exists only as a single phase. In the present disclosure, the term "dense fluid" as applied to a multi-component fluid is defined to include both a supercritical fluid and a single-phase fluid which exists at a temperature below its critical temperature and a pressure above its bubble point or saturation pressure. A dense fluid which is a multi-component fluid also can be defined as a single-phase fluid at a pressure above its critical pressure or a pressure above its bubble point or liquid saturation pressure. A multi-component dense fluid differs from a single-component dense fluid in that the liquid saturation pressure, critical pressure, and critical temperature are functions of composition. As described below, dense fluids are prepared according to the method of the present invention from an initial subcritical fluid having a fixed density and composition.

The definition of a dense fluid for a single component is illustrated in FIG. 1, which is a representative density-temperature phase diagram for carbon dioxide. This diagram shows saturated liquid curve 1 and saturated vapor curve 3, which merge at critical point 5 at the critical temperature of 87.9° F. and critical pressure of 1,071 psia. Lines of constant pressure (isobars) are shown, including the critical isobar of 1,071 psia. Line 7 is the melting curve. The region to the left of and enclosed by saturated liquid curve 1 and saturated vapor curve 3 is a two-phase vapor-liquid region. The region outside and to the right of liquid curve 1, saturated vapor curve 3, and melting curve 7 is a single-phase fluid region. The dense fluid as defined herein is indicated by cross-hatched region 9.

Figure 2:
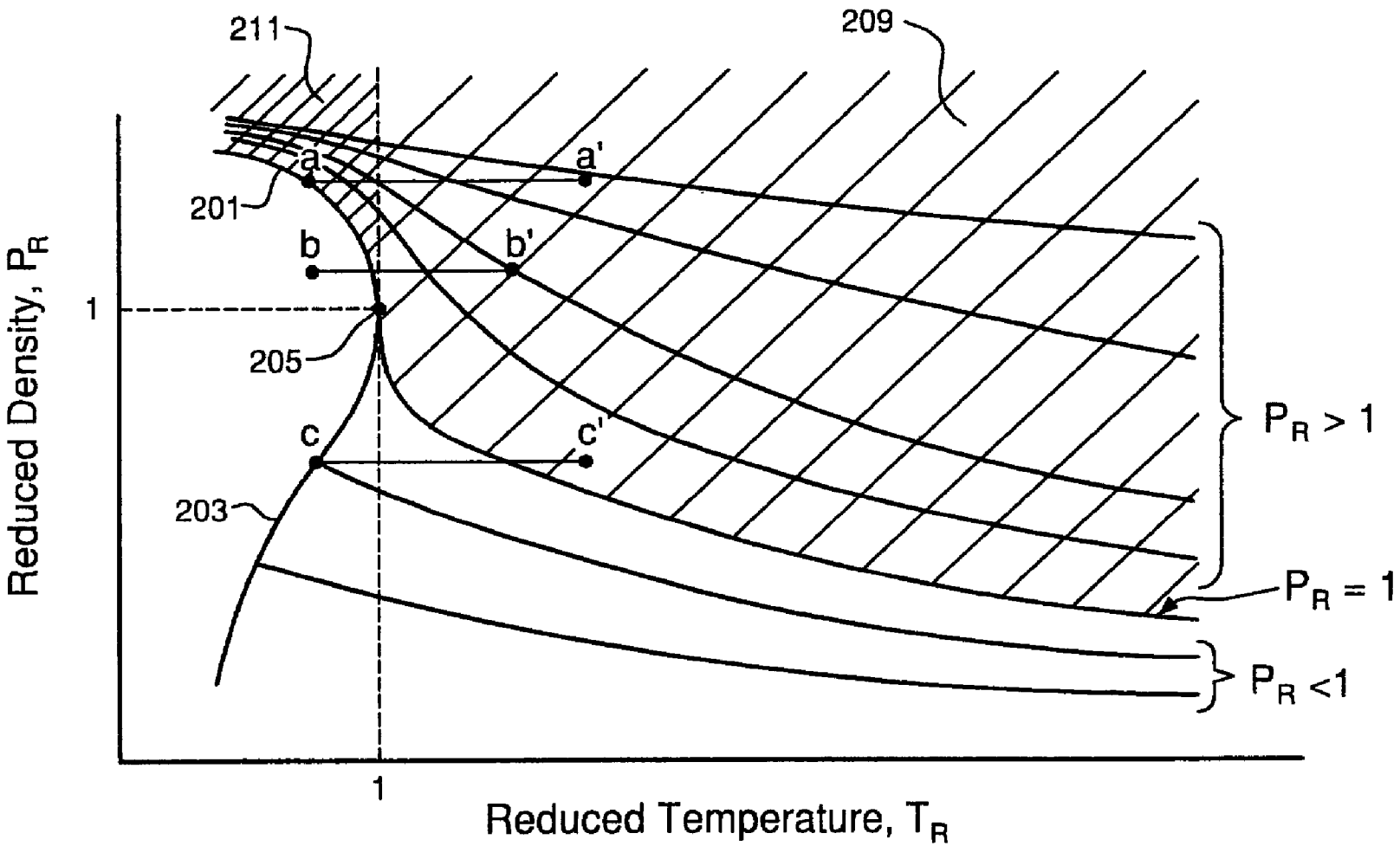
FIG. 2 is a generalized density-temperature phase diagram.

A generic density-temperature diagram can be defined in terms of reduced temperature, reduced pressure, and reduced density as shown in FIG. 2. The reduced temperature ($T_R$) is defined as the absolute temperature divided by the absolute critical temperature, reduced pressure ($P_R$) is defined as the absolute pressure divided by the absolute critical pressure, and reduced density ($\rho_R$) is defined as the density divided by the critical density. The reduced temperature, reduced pressure, and reduced density are all equal to 1 at the critical point by definition. FIG. 2 shows analogous features to FIG. 1 including saturated liquid curve 201 and saturated vapor curve 203, which merge at critical point 205 at a reduced temperature of 1, a reduced density of 1, and a reduced pressure of 1. Lines of constant pressure (isobars) are shown, including critical isobar 207 for which $P_R$=1. The region to the left of and enclosed by saturated liquid curve 201 and saturated vapor curve 203 is the two-phase vapor-liquid region. The crosshatched region 209 above the $P_R$=1 isobar and to the right of the critical temperature $T_R$=1 is a single-phase supercritical fluid region. The crosshatched region 211 above saturated liquid curve 201 and to the left of the critical temperature $T_R$=1 is a single-phase compressed liquid region. The dense fluid as defined herein includes both single-phase supercritical fluid region 209 and single-phase compressed liquid region 211.

The generation of a dense fluid by the method of the present invention is illustrated in FIG. 2. In one embodiment, a saturated liquid at point a is introduced into a vessel and sealed therein. The sealed vessel is heated isochorically, i.e., at essentially constant volume, and isopycnically, i.e., at essentially constant density. The fluid moves along the line as shown to point a' to form a supercritical fluid in region 209. This is generically a dense fluid as defined above. Alternatively, the fluid at point a may be heated to a temperature below the critical temperature ($T_R$=1) to form a compressed liquid. This also is a generic dense fluid as defined above. In another embodiment, a two-phase vapor liquid mixture at point b is introduced into a vessel and sealed therein. The sealed vessel is heated isochorically, i.e., at essentially constant volume, and isopycnically, i.e., at essentially constant density. The fluid moves along the line as shown to point b' to form a supercritical fluid in region 209. This is generically a dense fluid as defined above. In another embodiment, a saturated vapor at point c is introduced into a vessel and sealed therein. The sealed vessel is heated isochorically, i.e., at essentially constant volume, and isopycnically, i.e., at essentially constant density. The fluid moves along the line as shown to point c' to form a supercritical fluid in region 209. This is generically a dense fluid as defined above.

The final density of the dense fluid is determined by the volume of the vessel and the relative amounts of vapor and liquid originally introduced into the vessel. A wide range of densities thus is achievable by this method. The terms "essentially constant volume" and "essentially constant density" mean that the density and volume are constant except for negligibly small changes to the volume of the vessel which may occur when the vessel is heated.

A dense fluid for practical application in the present invention may be either a single-component fluid or a multi-component fluid, and may have a reduced temperature in the range of about 0.8 to about 1.8. The reduced temperature is defined here as the absolute temperature of the fluid divided by the absolute critical temperature of the fluid.

Dense fluids generated by the method of the present invention may be mixed with one or more processing agents to yield a mixed fluid defined herein as a dense processing fluid. This fluid may be used to perform processes such as film stripping, cleaning, drying, etching, planarization, deposition, extraction, or formation of suspended nano-particles and nano-crystals. For example, photoresist films can be removed using immersion in dense process fluids containing co-solvents such as propylene carbonate. Surfaces can be dried by first displacing residual surface moisture with methanol, then dissolving the methanol in a dense fluid. Conformal copper films can be deposited using dense fluid containing an organometallic precursor such as a betadiketonate, which is reduced on the heated surface using hydrogen. Uranium oxide can be dissolved and extracted from spent nuclear fuels using dense fluid carbon dioxide containing a complexant of tri-n-butylphosphate and nitric acid.

Figure 3:
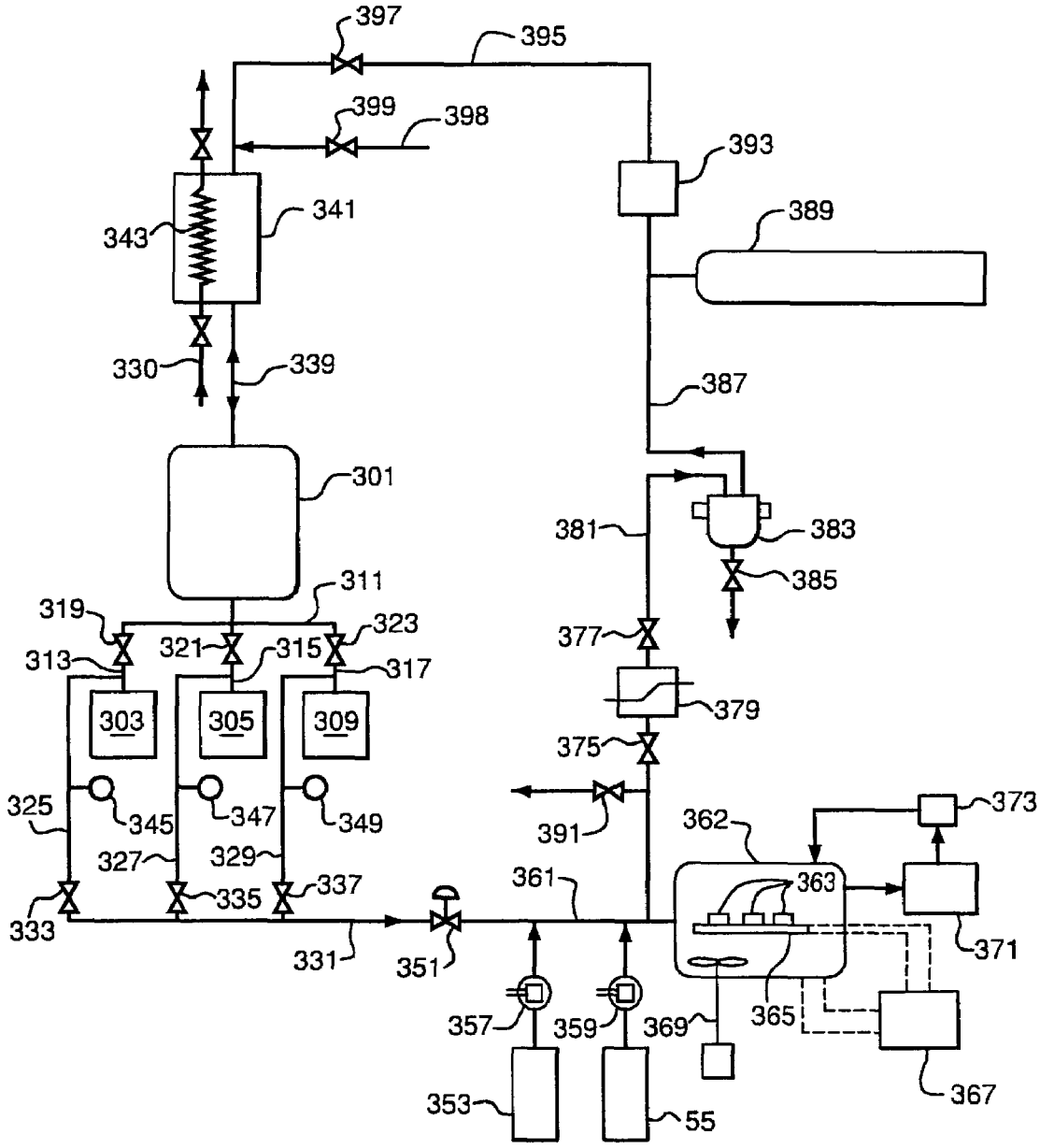
FIG. 3 is a process flow diagram illustrating an embodiment of the invention.

The invention can be illustrated by the generation and use of a dense processing fluid for use in the cleaning of an article such as a microelectronic component. An exemplary process for this application is shown in FIG. 3, which illustrates an isochoric (constant volume) carbon dioxide pressurization system to generate a carbon dioxide dense fluid for an electronic component cleaning chamber or processing tool, and includes a carbon dioxide recovery system to recycle carbon dioxide after separation of extracted contaminants. Liquid carbon dioxide and its equilibrium vapor are stored in carbon dioxide supply vessel 301, typically at ambient temperature; at 70° F., for example, the vapor pressure of carbon dioxide is 854 psia. At least one carbon dioxide pressurization vessel is located downstream of the supply vessel 301. In this embodiment, three pressurization vessels 303, 305, and 309 (described in more detail below) are shown in flow communication with carbon dioxide supply vessel 1 via manifold 311 and lines 313, 315, and 317 respectively. These lines are fitted with valves 319, 321, and 323, respectively, to control flow of carbon dioxide from supply vessel 301 to the pressurization vessels. Fluid supply lines 325, 327, and 329 are connected to manifold 331 via valves 333, 335, and 337 respectively.

Figure 4:
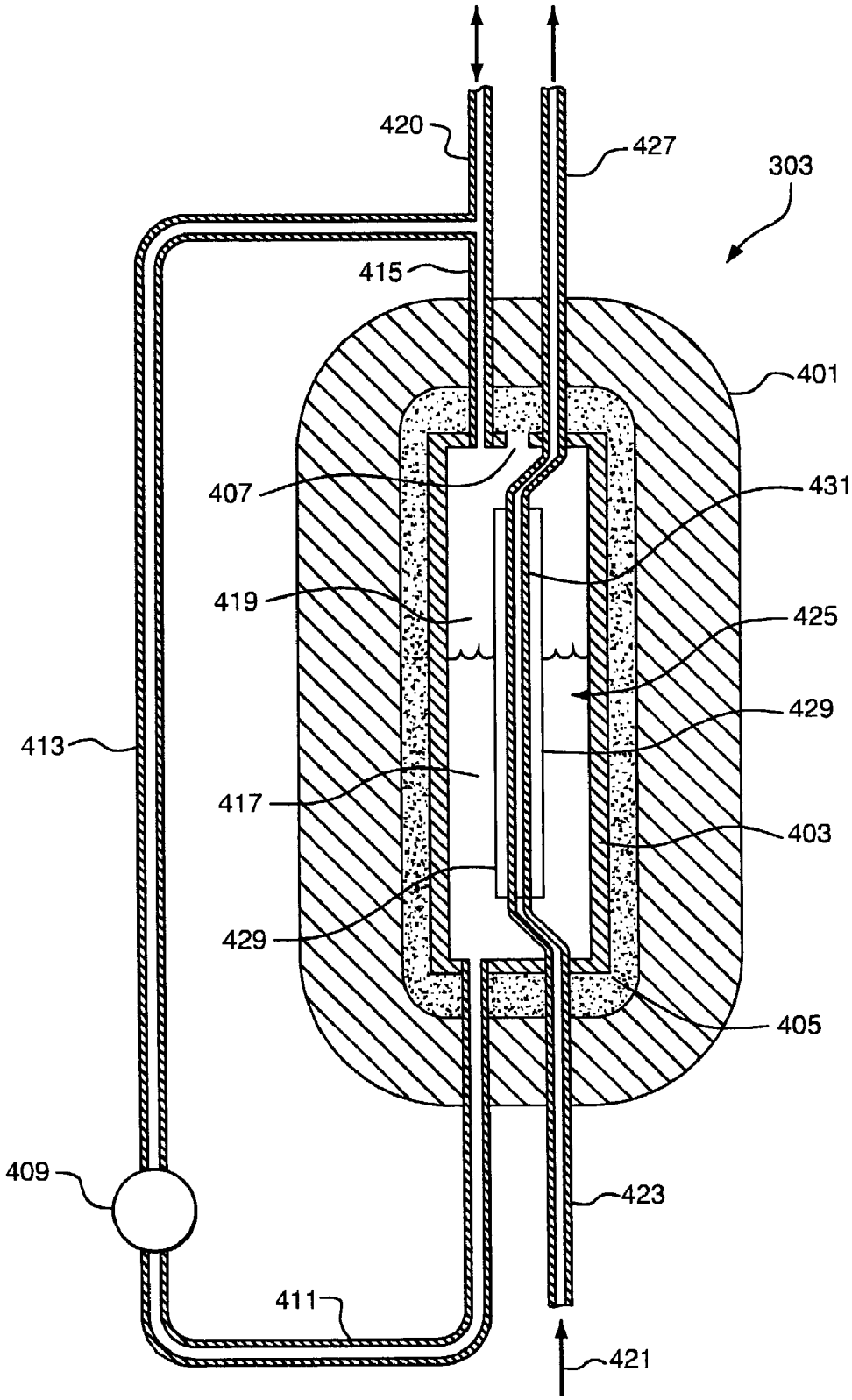
FIG. 4 is a schematic drawing of a pressurization vessel used in the process of FIG. 3.

A detailed illustration of pressurization vessel 303 is given in FIG. 4. Pressurization vessel 303 comprises outer pressure casing 401, inner vessel 403, and thermal insulation 405 between the inner vessel and the outer pressure casing. The thermal mass of inner vessel 403 is preferably minimized to minimize the cool-down time when the vessel is initially filled from carbon dioxide supply vessel 1. Inner vessel 403 is in fluid communication with thermal insulation 405 via opening 407 to ensure that the pressures inside and outside of inner vessel 403 are approximately equal, which allows the wall thickness and thermal mass of inner vessel 403 to be minimized. Opening 407 may contain a de-misting medium, such as metal mesh or porous sintered metal (not shown), to prevent liquid carbon dioxide droplets from migrating into thermal insulation 405.

The level of liquid in the pressurization vessel may be monitored conveniently by differential pressure sensor 409, which is in fluid communication with the interior of inner vessel 403 via lines 411, 413, and 415. A typical liquid level is shown between liquid 417 and vapor 419 in inner vessel 403. Inner vessel 403 is in fluid communication with lines 313 and 325 of FIG. 3 via line 420.

Heat may be supplied to inner vessel 403 by any desired method. In one embodiment, hot heating fluid 421 is supplied via line 423 to heat exchanger 425, which heats liquid 417 and vapor 419 by indirect heat exchange. Cooled heating fluid is withdrawn via line 427. Heat exchanger 425 can be any type of heat exchange assembly. One type of useful heat exchange assembly is a longitudinally-finned pipe as shown in which a plurality of fins 429 are brazed or welded to pipe 431. The temperature and flow rate of heating fluid 421 may be regulated to control the heating rate during pressurization and the final temperature and pressure of the dense fluid formed within inner vessel 403.

Returning now to FIG. 3, carbon dioxide supply vessel 301 is connected via two-way flow line 339 to carbon dioxide liquefier 341 located above the carbon dioxide supply vessel 301. Heat exchanger 343, which may be a plate and fin or other type of heat exchanger such as heat exchanger 425 of FIG. 4, is used to cool the interior of liquefier 341. A cooling fluid is supplied via line 330 and may be, for example, cooling water at an ambient temperature of 70° F., which will maintain the pressure in carbon dioxide supply vessel 301 at the corresponding carbon dioxide vapor pressure of 854 psia.

In this illustration, valve 319 is open while valves 321, 323, and 333 are closed. Valve 335 or 337 may be open to supply supercritical carbon dioxide to manifold 331 from pressurization vessel 305 or 309, which previously may have been charged with carbon dioxide and pressurized as described below. Liquid carbon dioxide from supply vessel 301 flows downward into pressurization vessel 303 via manifold 311, valve 319, and line 313. As the liquid carbon dioxide enters pressurization vessel 303, which was warmed in a previous cycle, initial liquid flashing will occur. Warm flash vapor returns upward into the carbon dioxide supply vessel 301 via line 313 and manifold 311 as liquid flows downward into pressurization vessel 303. The warm flash vapor flows back into carbon dioxide supply vessel 301 and increases the pressure therein. Excess vapor flows from supply vessel 301 via line 339 to carbon dioxide liquefier 341, wherein the vapor is cooled and condensed to flow downward via line 339 back to supply vessel 301.

After initial cooling and pressurization, liquid carbon dioxide flows from supply vessel 301 into pressurization vessel 303. When the pressurization vessel is charged with liquid carbon dioxide to a desired depth, valve 319 is closed to isolate the vessel. The carbon dioxide isolated in vessel 303 is heated by indirect heat transfer as described above and is pressurized as temperature increases. The pressure is monitored by pressure sensor 345 (pressure sensors 347 and 349 are used similarly for vessels 305 and 309 respectively). As heat is transferred to the carbon dioxide in vessel 303, the temperature and pressure rise, the separate liquid and vapor phases become a single phase, and a dense fluid is formed. This dense fluid may be heated further to become a supercritical fluid, which by definition is a fluid at a temperature above its critical temperature and a pressure above its critical pressure. Conversely, the subcritical fluid is defined as a fluid at a temperature below its critical temperature or a pressure below its critical pressure. The carbon dioxide charged to pressurization vessel 303 prior to heating is a subcritical fluid. This subcritical fluid may be a saturated vapor, a saturated liquid, or a two-phase fluid having coexisting vapor and liquid phases.

As additional heat is transferred, the temperature and pressure quickly rise to supercritical levels to form a supercritical fluid having a desired density. The final carbon dioxide pressure in the pressurization vessel of a known volume can be predicted from the volume of the initial liquid charge. For example, at 854 psia and 70° F. the density of liquid carbon dioxide in the vessel is 47.6 lb/ft$^3$ and the density of the coexisting carbon dioxide vapor is 13.3 lb/ft$^3$. If the liquid carbon dioxide charge occupies 46.3% of the volume of the vessel, then the carbon dioxide vapor occupies the remaining 53.7% of the volume. In this example, the average density of all carbon dioxide in the vessel can be calculated as 0.463 (47.6)+0.537 (13.3), or 29.2 lb/ft$^3$.

Since the internal volume of the vessel and the mass of carbon dioxide in the vessel remain essentially unchanged during the heating step, the average density of the captured carbon dioxide will remain essentially unchanged at 29.2 lb/ft$^3$ regardless of the temperature and pressure. In this example, heating the selected initial charge of carbon dioxide isochorically (at constant volume) at a fixed density of 29.2 lb/ft$^3$ will pass through the critical point at the critical temperature of 87.9° F. and the critical pressure of 1,071 psia. Additional heating will form a supercritical fluid at the desired temperature and pressure having a fixed density of 29.2 lb/ft$^3$. Using a smaller initial quantity of liquid carbon dioxide in the vessel will result in a lower density supercritical fluid; conversely, using a greater initial quantity of liquid carbon dioxide in the vessel will result in a higher density supercritical fluid. Heating a higher density supercritical fluid to a given temperature will generate a higher pressure than heating a lower density supercritical fluid to the same temperature.

The highest theoretically achievable pressure is obtained when the pressurization vessel initially is completely filled with liquid carbon dioxide, leaving no vapor head space in the vessel. For example, the average density of the saturated carbon dioxide liquid in the vessel at 70° F. is 47.6 lb/ft$^3$. Initial heating of the liquid carbon dioxide will change the saturated liquid into a dense fluid in a region of the phase diagram sometimes termed a compressed liquid or subcooled liquid. As the fluid is heated above the critical temperature of 87.9° F., it becomes a supercritical fluid by definition. In this example, the carbon dioxide may be heated at a constant density of 47.6 lb/ft$^3$ to a temperature of 189° F. to yield a supercritical fluid at a pressure of approximately 5,000 psia.

By using the method illustrated in the above examples, a dense fluid can be prepared at any selected density, temperature, and pressure. Only two of these three parameters are independent when the composition is fixed; the preferred and most convenient way to prepare a dense fluid is to select an initial charge density and composition in the pressurization vessel and then heat the charge to a desired temperature. Proper selection of the initial charge density and composition will yield the desired final pressure.

When carbon dioxide is used for a single-component dense processing fluid, the carbon dioxide may be heated to a temperature between about 100° F. and about 500° F. to generate the desired dense fluid pressure in the pressurization vessel. More generally, when using any component or components for the dense fluid, the fluid may be heated to a reduced temperature in the pressurization vessel of up to about 1.8, wherein the reduced temperature is defined as the average absolute temperature of the fluid in the pressurization vessel after heating divided by the absolute critical temperature of the fluid. The critical temperature is defined for a fluid containing any number of components as that temperature above which the fluid always exists as a single fluid phase and below which two phases may form.

Returning now to FIG. 3, valve 333 is opened and dense fluid prepared as described above passes through manifold 331 under flow control through metering valve 351. Optionally, one or more entrainers or processing agents from entrainer storage vessels 353 and 355 may be introduced by pumps 357 and 359 into the dense fluid in line 361 to provide a dense processing fluid, which in this application may be described as a dense cleaning fluid. The dense cleaning fluid is introduced into sealed cleaning chamber or process tool 362 which holds one or more articles 363 to be cleaned and valve 333 is closed. These articles were previously placed on holder 365 in process tool 362 via a sealable entry port (not shown).

The initial pressure in pressurization vessel 303 and the temperature in process tool 362 are selected so that the dense cleaning fluid in process tool 362 after the transfer step typically is a single-phase dense fluid as defined above, whether or not an entrainer or other processing agent is added to the original dense fluid. Alternatively, the dense processing fluid may be an emulsion or suspension containing a second suspended or dispersed phase containing the processing agent.

A wide variety of contamination-sensitive articles encountered in the fabrication of microelectronic devices and micro-electromechanical devices can be cleaned using the present invention. Such articles may include, for example, silicon or gallium arsenide wafers, reticles, photomasks, flat panel displays, internal surfaces of processing chambers, printed circuit boards, surface mounted assemblies, electronic assemblies, sensitive wafer processing system components, electro-optical, laser and spacecraft hardware, surface micro-machined systems, and other related articles subject to contamination during fabrication. Typical contaminants to be removed from these articles may include, for example, low and high molecular weight organic contaminants such as exposed photoresist material, photoresist residue, UV- or X-ray-hardened photoresist, C—F-containing polymers and other organic and inorganic etch residues, ionic and neutral, light and heavy inorganic (metal) species, moisture, and insoluble materials, including post-planarization particles.

Sealed process tool 362 is pressurized with the dense cleaning fluid to a typical supercritical pressure of 1,100 to 10,000 psia and a supercritical temperature of up to 500° F. The temperature in process tool 362 is controlled by means of temperature control system 367. Typically, the contacting of articles 363 with the dense cleaning fluid in process tool 362 may be effected at a reduced temperature above 1.0 and below about 1.2, wherein the reduced temperature is defined as the average absolute temperature of the fluid in the cleaning chamber divided by the absolute critical temperature of the fluid.

Several alternatives to the introduction of entrainer or processing agent into line 361 to mix with the dense fluid prior to flowing into process tool 362 are possible. In one alternative, entrainer may be introduced directly into process tool 362 before the tool is charged with dense fluid from pressurization vessel 303. In another alternative, entrainer may be introduced directly into process tool 362 after the tool is charged with dense fluid. In yet another alternative, entrainer may be introduced directly into pressurization vessel 303 before the vessel is charged from supply vessel 301. In a further alternative, entrainer may be introduced directly into pressurization vessel 303 after the vessel is charged from supply vessel 301 but before the vessel is heated. In a final alternative, entrainer may be introduced directly into pressurization vessel 303 after the vessel is charged from supply vessel 301 and after the vessel is heated. Any of these alternatives can be accomplished using the appropriate lines, manifolds, and valves in FIG. 3.

Fluid agitator system 369 mixes the interior of process tool 362 to promote contact of the dense cleaning fluid with articles 363. Additional fluid agitation may be provided by a recirculating fluid system consisting of pump 371 and filter 373. Filter 373 serves to remove particulate contamination from the recirculating fluid, and the resulting fluid agitation mixes the dense fluid and promotes removal of contaminants or reaction products from the contaminated articles by increasing convective fluid motion.

When the cleaning cycle is complete, process tool 362 is depressurized by opening valves 375 and 377 whereby the contaminated dense fluid flows through heat exchanger 379, where it is cooled to a temperature of 70° F. to 150° F. This reduction in pressure and temperature condenses the dissolved contaminants and entrainers in the dense fluid, and the resulting fluid containing suspended contaminants and entrainers flows via line 381 into separator 383. Condensed contaminants and entrainers are removed via line 385 and the purified fluid flows via line 387 to intermediate fluid storage vessel 389. The pressure in storage vessel 389 is between the supercritical extraction pressure in process tool 362 and the pressure of carbon dioxide supply vessel 301. Typically, process tool 362 is depressurized in this step to a pressure of 900 to 1,100 psia.

During the depressurization step, valve 333 optionally may be opened so that carbon dioxide from pressurization vessel 303 also flows through cooler 370 and separator 383 with the contaminated depressurization fluid. Optionally, after process tool 362 is initially depressurized, carbon dioxide from pressurization vessel may be used to partially pressurize and rinse process tool 362 to dilute and remove residual contaminants and entrainers therefrom, after which the process tool would be depressurized through cooler 379 and separator 383 to a pressure of 900 to 1,100 psia. The remaining carbon dioxide in process tool 362 then is vented through valve 391 to reduce the pressure to atmospheric. Process tool optionally may be evacuated to a subatmospheric pressure. At this point, the sealable entry port (not shown) of process tool 362 is opened, the cleaned articles are removed, and another group of contaminated articles is loaded for the next cleaning cycle.

Optionally, another cooler and separator (not shown) similar to cooler 379 and separator 383 may be installed in line 387. The use of this second stage of separation at an intermediate pressure allows more efficient separation of contaminants and entrainers from the carbon dioxide solvent, and may allow a degree of fractionation between the contaminants and entrainers.

Carbon dioxide in intermediate fluid storage vessel 389, typically at a pressure in the range of 900 to 1,100 psia, may be filtered by filter system 393 before being recycled via line 395 and valve 397 to liquefier 341, where it is liquefied and returned to carbon dioxide supply vessel 1 for reuse. Makeup carbon dioxide may be added as a vapor through line 398 and valve 399 or added as a liquid directly (not shown) to carbon dioxide supply vessel 301.

Alternatively, the purified carbon dioxide in line 387 or line 395 may be vented directly to the atmosphere (not shown) without recycling as described above. In this embodiment, the carbon dioxide is introduced via line 398 and valve 399 and is used in a once-through mode.

Multiple pressurization vessels may be used in the exemplary process as described above. For example, when pressurization vessel 303 of FIG. 3 is in the process of filling and heating, pressurization vessel 305 (which was previously filled and heated to provide dense fluid at the desired conditions) can supply process tool 362 via line 327, valve 335, manifold 331, and line 361. A cycle can be envisioned in which the three pressurization vessels 303, 305, and 307 operate in a staggered cycle in which one supplies dense fluid to process tool 362, another is being filled with carbon dioxide from carbon dioxide supply vessel 301, and the third is being heated after filling. Utilizing multiple pressurization vessels in this manner increases the productivity of process tool 362 and allows for backup if one of the pressurization vessels is taken off line for maintenance.

The exemplary process described above uses carbon dioxide as the dense fluid, but other dense fluid components may be used for appropriate applications. The dense fluid may comprise one or more components selected from the group consisting of carbon dioxide, nitrogen, methane, oxygen, ozone, argon, hydrogen, helium, ammonia, nitrous oxide, hydrocarbons having 2 to 6 carbon atoms, hydrogen fluoride, hydrogen chloride, sulfur trioxide, fluoroform, sulfur hexafluoride, nitrogen trifluoride, monofluoromethane, difluoromethane, trifluoromethane, trifluoroethane, tetrafluoroethane, pentafluoroethane, perfluoropropane, pentafluoropropane, hexafluoroethane, and tetrafluorochloroethane.

A dense processing fluid is generically defined as a dense fluid to which one or more processing agents have been added. A processing agent is defined as a compound or combination of compounds that promote physical and/or chemical changes to an article or substrate in contact with the dense processing fluid. These processing agents may include film strippers, cleaning or drying agents, entrainers, etching or planarization reactants, and deposition materials or reactants. The total concentration of these processing agents typically is less that about 50 wt % and the dense processing fluid typically remains a single dense phase after a processing agent is added to a dense fluid. Alternatively, the dense processing fluid may be an emulsion or suspension containing a second suspended or dispersed phase containing the processing agent.

The exemplary process described above with reference to FIG. 3 utilizes an entrainer mixed with a dense fluid to provide a dense film stripping or cleaning fluid containing 0.5 to 20 wt % entrainer. An entrainer is defined as a processing agent which enhances the cleaning ability of the dense fluid to remove contaminants from a contaminated article. Entrainers generally may include solvents, surfactants, chelators and chemical modifiers. Some examples of representative entrainers are acetylenic alcohols, acetylenic diols (non-ionic alkoxylated and/or self-emulsifiable acetylenic diol surfactants), siloxane polymers (silicone-based surfactants and defoamers), alcohols, tertiary and quaternary alkyl amines and di-amines, amides (including aprotic solvents such as dimethyl formamide and dimethyl acetamide), alkyl alkanolamines (such as dimethanolethylamine), and chelating agents such as beta-diketone and beta-ketoimine ligands, trifluoroacetic anhydride (TFAA) and/or halogenated carboxylic acids, glycols, alkanes, and ketones.

Dense processing fluids prepared and managed by the methods of the present invention also may be used in other processing steps in the manufacture of electronic components in which material is removed from a part (etching or planarization) or in which material is deposited on a part (deposition). In these alternatives, appropriate processing agents or reactive compounds may be added to the dense fluid to form a dense processing fluid. Some representative reactive compounds that may be added to a dense fluid as processing agents for etching or planarization processes include hydrogen fluoride, hydrogen chloride, hexafluoroethane, and nitrogen trifluoride. Some representative reactive and non-reactive compounds that may be added to a dense fluid for deposition processes include organometallic precursors, photoresists, photoresist developers, interlayer dielectric materials, silane reagents and various coating materials, including but not limited to stain resistant coatings. Methanol is a representative compound that may be added to a dense fluid for drying processes. In these alternative uses of dense processing fluids, process tool 362 of FIG. 3 used for cleaning as described above may be replaced with the appropriate process tool for these alternative applications.

The term "processing" as used herein means contacting an article with a dense processing fluid to effect physical and/or chemical changes to the article. The term "article" as used herein means any article of manufacture which can be contacted with a dense processing fluid. Representative articles may include, for example, silicon or gallium arsenide wafers, reticles, photomasks, flat panel displays, internal surfaces of processing chambers, printed circuit boards, surface mounted assemblies, electronic assemblies, sensitive wafer processing system components, electro-optical, laser and spacecraft hardware, surface micro-machined systems, and other related articles subject to contamination during fabrication.

The following Example illustrates the present invention but does not limit the invention to any of the specific details described therein.

EXAMPLE

The invention according to FIG. 3 is used to treat a silicon wafer with a dense processing fluid as described below.

Step 1: Pressurization vessel 303 having a volume of 4.72 liters is filled completely with 7.94 lb of saturated liquid $CO_2$ at 70° F. and 853.5 psia. The density of the initial $CO_2$ charge is 47.6 lb/ft$^3$. The vessel is sealed.

Step 2: The pressurization vessel is heated until the internal pressure reaches 5,000 psia. The density of the contained $CO_2$ remains at 47.6 lb/ft$^3$, and the temperature reaches 189° F. The contained $CO_2$ is converted to a dense fluid in the supercritical region (see FIG. 1).

Step 3: A contaminated silicon wafer is loaded into process tool 362 having an interior volume of 1 liter. The process tool is evacuated and the vessel walls and wafer are held at 189° F.

Step 4: Valve 333 connecting pressurization vessel 303 via manifold 331 and line 361 to the process tool 362 is opened, $CO_2$ flows from pressurization vessel 303 into process tool 362, and the wafer is immersed in dense phase $CO_2$. The common temperature of pressurization vessel 303 and process tool 362 is 189° F. The common pressure of the pressurization vessel and process module is 3,500 psia. The dense phase $CO_2$ remains in the supercritical state in both vessels while 1.39 lb of $CO_2$ flows into 1 liter process tool 362 while the remaining 6.55 lb of $CO_2$ remains in 4.72 liter pressurization vessel 303.

Step 5: An entrainer, propylene carbonate, is pumped from entrainer storage vessel 353 by pump 357 into process tool 362 and the process tool is isolated. The concentration of propylene carbonate in the dense fluid in the process tool is 1 wt %. The dense fluid is agitated in process tool 362 for one to two minutes, during which time the wafer is processed to remove contaminants.

Step 6: Valves 333, 351, 375, 377, and 397 are opened so that fluid in process tool 362 and pressurization vessel 303 flows through cooler 379 and phase separator 383 to carbon dioxide liquefier 341 while the pressure in the system is held at 900 psia. Entrainers, reaction products, and contaminants are separated from the $CO_2$ in the separator 383. The common temperature of the pressurization vessel and process module remains at 189° F. during this step, and the $CO_2$ is in the vapor state in both vessels. Neglecting the relatively small effect of other mixture constituents, the common density of the $CO_2$ in process tool 362 and pressurization vessel 303 is 7.07 lb/ft$^3$. 0.25 lb of $CO_2$ remains in the process tool 362.

Step 7: Pressurization vessel 303 is isolated by closing valve 333 and the vessel is cooled to 70° F., wherein the pressure falls to 632 psia, and the density of the contained $CO_2$ vapor in the vessel remains at 7.07 lb/ft$^3$.

Step 8: The remaining 0.25 lb of $CO_2$ in the process tool 362 is vented by closing valve 375 and opening valve 391, the tool is evacuated, and the clean, processed silicon wafer is removed.

The cycle is repeated by returning pressurization vessel 303 to Step 1 by refilling with liquid $CO_2$.

The invention claimed is:

1. A method for processing an article comprising:

(a) introducing the article into a sealable processing chamber and sealing the processing chamber;

(b) preparing a single-phase supercritical dense fluid by:

(b1) cooling fluid in a separate liquefier to produce condensed subcritical fluid;

(b2) supplying condensed subcritical fluid from the liquefier into a supply vessel;

(b3) introducing the subcritical fluid from the supply vessel into a pressurization vessel and isolating the pressurization vessel; and (b4) heating the subcritical fluid at essentially constant volume and essentially constant density to yield a single-phase supercritical dense fluid;

(c) transferring at least a portion of the single-phase supercritical dense fluid from the pressurization vessel to the processing chamber, wherein the transfer of the single-phase supercritical dense fluid is driven by the difference between the pressure in the pressurization vessel and the pressure in the processing chamber, thereby pressurizing the processing chamber with transferred dense fluid;

(d) contacting the article with the transferred dense fluid to yield a spent dense fluid and a treated article; and (e) separating the spent dense fluid from the treated article.

2. The method of claim 1 wherein the dense fluid is generated in (b3) at a reduced temperature in the pressurization vessel between 1.0 to about 1.8, wherein the reduced temperature is defined as the average absolute temperature of the dense fluid in the pressurization vessel after heating divided by the absolute critical temperature of the fluid.

3. The method of claim 2 wherein the contacting of the article with the dense fluid in the processing chamber in (d) is effected at a reduced temperature in the processing chamber between 1.0 and about 1.2, wherein the reduced temperature is defined as the average absolute temperature of the dense fluid in the processing chamber during (d) divided by the absolute critical temperature of the dense fluid.

4. The method of claim 1 wherein the dense fluid comprises carbon dioxide.

5. The method of claim 1 which further comprises providing a dense processing fluid by one or more steps selected from the group consisting of (1) introducing one or more processing agents into the dense fluid during the transferring of the dense fluid from the pressurization vessel to the processing chamber, (2) introducing one or more processing agents into the processing chamber before the transferring of the dense fluid from the pressurization vessel to the processing chamber, (3) introducing one or more processing agents into the dense fluid in the processing chamber after the transferring of the dense fluid from the pressurization vessel to the processing chamber, (4) introducing one or mere processing agents into the pressurization vessel before introducing the subcritical fluid into the pressurization vessel, (5) introducing one or more processing agents into the pressurization vessel after introducing the subcritical fluid into the pressurization vessel but before heating the pressurization vessel, and (6) introducing one or more processing agents into the pressurization vessel after introducing the subcritical fluid into the pressurization vessel and after heating the pressurization vessel.

6. The method of claim 5 wherein the total concentration of the one or more processing agents in the dense processing fluid is between about 0.5 and 20 wt%.

7. The method of claim 5 wherein the one or more processing agents comprise hydrogen fluoride.

8. The method of claim 1 which further comprises reducing the pressure of the spent dense fluid to yield at least a fluid phase and a contaminant and entrainer phase, and separating the phases to yield a purified fluid and recovered contaminants and entrainers.

9. The method of claim 8 which further comprises recycling the purified fluid to provide a portion of the subcritical fluid in (b3).

10. The method of claim 8 which further comprises reducing the pressure of the purified fluid to yield a further-purified fluid phase and an additional contaminant and entrainer phase, and separating the phases to yield a further-purified fluid and additional recovered contaminants and entrainers.

11. The method of claim 10 which further comprises recycling the further-purified fluid to provide a portion of the subcritical fluid in (b3).

12. The method of claim 1 wherein the subcritical fluid in the pressurization vessel prior to heating in (b4) comprises a vapor phase, a liquid phase, or coexisting vapor and liquid phases.

* * * * *

UNITED STATES PATENT AND TRADEMARK OFFICE

CERTIFICATE OF CORRECTION

PATENT NO. : 7,282,099 B2
APPLICATION NO. : 10/253296
DATED : October 16, 2007
INVENTOR(S) : Wayne T. McDermott, Richard C. Ockovic and Alexander Schwarz It is certified that error appears in the above-identified patent and that said Letters Patent is hereby corrected as shown below:

Column 16, Line 13

In claim 5 delete the word “mere” and insert the word -- more --

Signed and Sealed this

Eighteenth Day of December, 2007

JON W. DUDAS
*Director of the United States Patent and Trademark Office*